US010553969B2

(12) United States Patent
Hwang et al.

(10) Patent No.: US 10,553,969 B2
(45) Date of Patent: Feb. 4, 2020

(54) ELECTRICAL CONNECTOR HOUSING WITH HYBRID STRUCTURE VIA DUAL-MOLDING

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Tzu-Yao Hwang, New Taipei (TW); Ke-Hao Chen, New Taipei (TW)

(73) Assignees: FOXCONN (KUNSHAN) COMPUTER CONNECTOR CO., LTD., Kunshan (CN); FOXCONN INTERCONNECT TECHNOLOGY, Grand Cayman (KY)

( * ) Notice: Subject to any disclaimer, the term of this patent is extended or adjusted under 35 U.S.C. 154(b) by 0 days.

(21) Appl. No.: 16/226,513

(22) Filed: Dec. 19, 2018

(65) Prior Publication Data

US 2019/0190173 A1 Jun. 20, 2019

(30) Foreign Application Priority Data

Dec. 19, 2017 (CN) ..... 2017 1 1371480

(51) Int. Cl.

| | |
|---|---|
| ***H01R 12/70*** | (2011.01) |
| ***H01R 13/64*** | (2006.01) |
| ***H01R 13/639*** | (2006.01) |
| ***H01R 13/6461*** | (2011.01) |

(52) U.S. Cl.

CPC ..... *H01R 12/7076* (2013.01); *H01R 13/639* (2013.01); *H01R 13/6461* (2013.01)

(58) Field of Classification Search

CPC .. H01R 12/714; H01R 12/70; H01R 13/6461; H01R 13/639

See application file for complete search history.

(56) References Cited

U.S. PATENT DOCUMENTS 8,814,603 B2 * 8/2014 Chang ..... H01R 24/00 439/626
9,065,216 B2 * 6/2015 Chang ..... H01R 13/6585
9,837,737 B1 * 12/2017 Huang ..... H01R 12/7076

(Continued)

FOREIGN PATENT DOCUMENTS

CN 203445353 U 2/2014
CN 103378492 B 3/2016

*Primary Examiner* — Xuong M Chung Trans
(74) *Attorney, Agent, or Firm* — Wei Te Chung; Ming Chieh Chang

(57) ABSTRACT

An electrical for connecting an electronic package to a printed circuit board, includes a housing and a plurality of contacts therein. The contacts include grounding contacts and signal contacts mixed with each other. The housing includes an insulative plastic body and a conductive plastic body wherein the insulative plastic body includes a main plate and a plurality of columns extending downwardly from the main plate. Each column forms an insulative retaining passageway for receiving the signal contact. The conductive plastic body includes a block with two opposite top and bottom surfaces, and plurality of conductive retaining passageways for receiving the grounding contacts, and a plurality of receiving cavities for receiving the columns are commonly formed in the conductive plastic body in a mixed manner.

20 Claims, 6 Drawing Sheets

(56) References Cited

U.S. PATENT DOCUMENTS

| | | | | |
|---|---|---|---|---|
| 10,122,111 | B1 * | 11/2018 | Ju | H01R 12/7076 |
| 2013/0237091 | A1 * | 9/2013 | Mason | H01R 13/6585<br>439/607.05 |
| 2018/0375262 | A1 * | 12/2018 | Ju | H01R 13/6597 |

* cited by examiner

ELECTRICAL CONNECTOR HOUSING WITH HYBRID STRUCTURE VIA DUAL-MOLDING

1. FIELD OF THE INVENTION

The invention relates to the electrical connector, and particularly to an electrical connector connecting an electronic package to a printed circuit board and the method of making the same.

2. DESCRIPTION OF RELATED ART

U.S. Pat. Nos. 8,821,192 and 9,178,322 disclose the electrical connectors for connecting the electronic package to the printed circuit board wherein the metallic structure surrounds the individual signal contact with superior shielding for high frequency transmission. Anyhow, the former needs the complicate manufacturing process and tends to contaminate the signal contacts, and the latter may need additional space disadvantageously.

It is desired to have the electrical connector with reliable shielding effect via a relatively easy manufacturing method and without taking additional space.

SUMMARY OF THE INVENTION

An object of the invention is to provide an electrical for connecting an electronic package to a printed circuit board wherein the electrical connector includes a housing and a plurality of contacts therein. The contacts include grounding contacts and signal contacts mixed with each other. The housing includes an insulative plastic body and a conductive plastic body wherein the insulative plastic body includes a main plate and a plurality of columns extending downwardly from the main plate. Each column forms an insulative retaining passageway for receiving the signal contact. The conductive plastic body includes a block with two opposite top and bottom surfaces and plurality of conductive retaining passageways for receiving the grounding contacts, and a plurality of receiving cavities for receiving the columns are commonly formed in the conductive plastic body in a mixed manner. After assembled, each individual signal contact is indirectly surrounded by the conductive plastic body via the corresponding column located therebetween for electrical isolation while each grounding contact is directly surrounded and connected to the conductive plastic body. The insulative passageways and the conductive passageways are optimally same with each other, and the signal contacts and the grounding contacts are optimally same with each other correspondingly.

Other objects, advantages and novel features of the invention will become more apparent from the following detailed description when taken in conjunction with the accompanying drawings.

DETAILED DESCRIPTION OF THE PREFERRED EMBODIMENT

Figure 1:
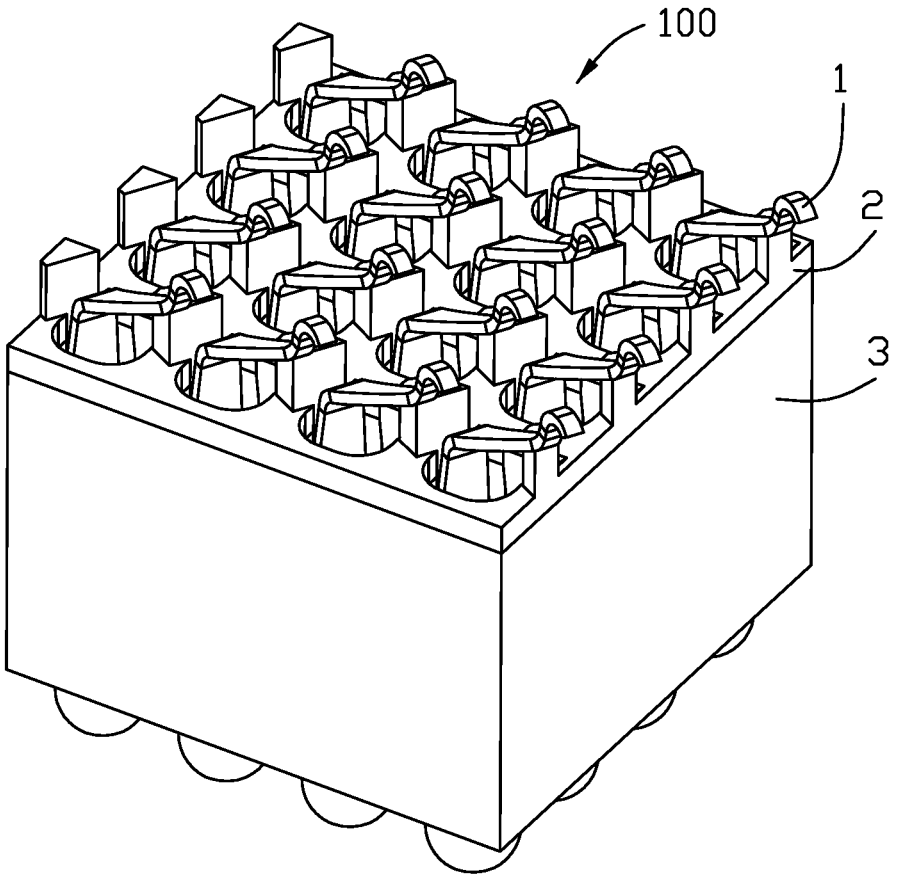
FIG. 1 is a perspective view of an electrical connector of the preferred embodiment of the invention.
Figure 2:
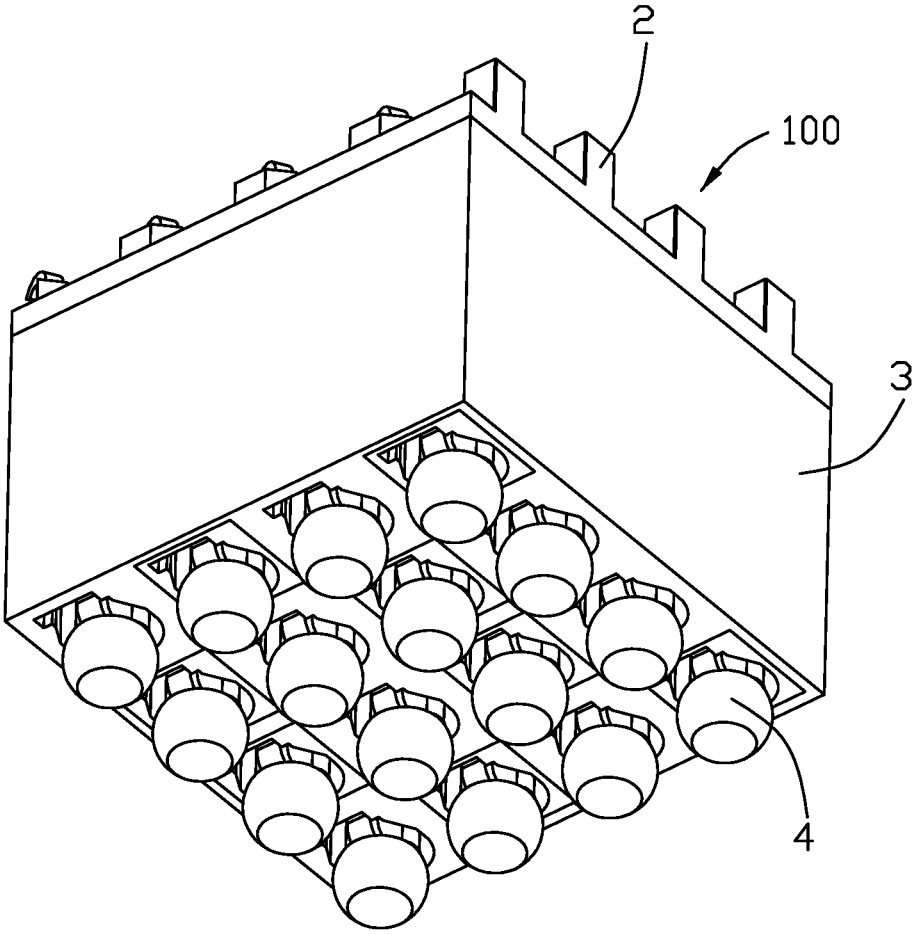
FIG. 2 is another perspective view of the electrical connector of FIG. 1.
Figure 3:
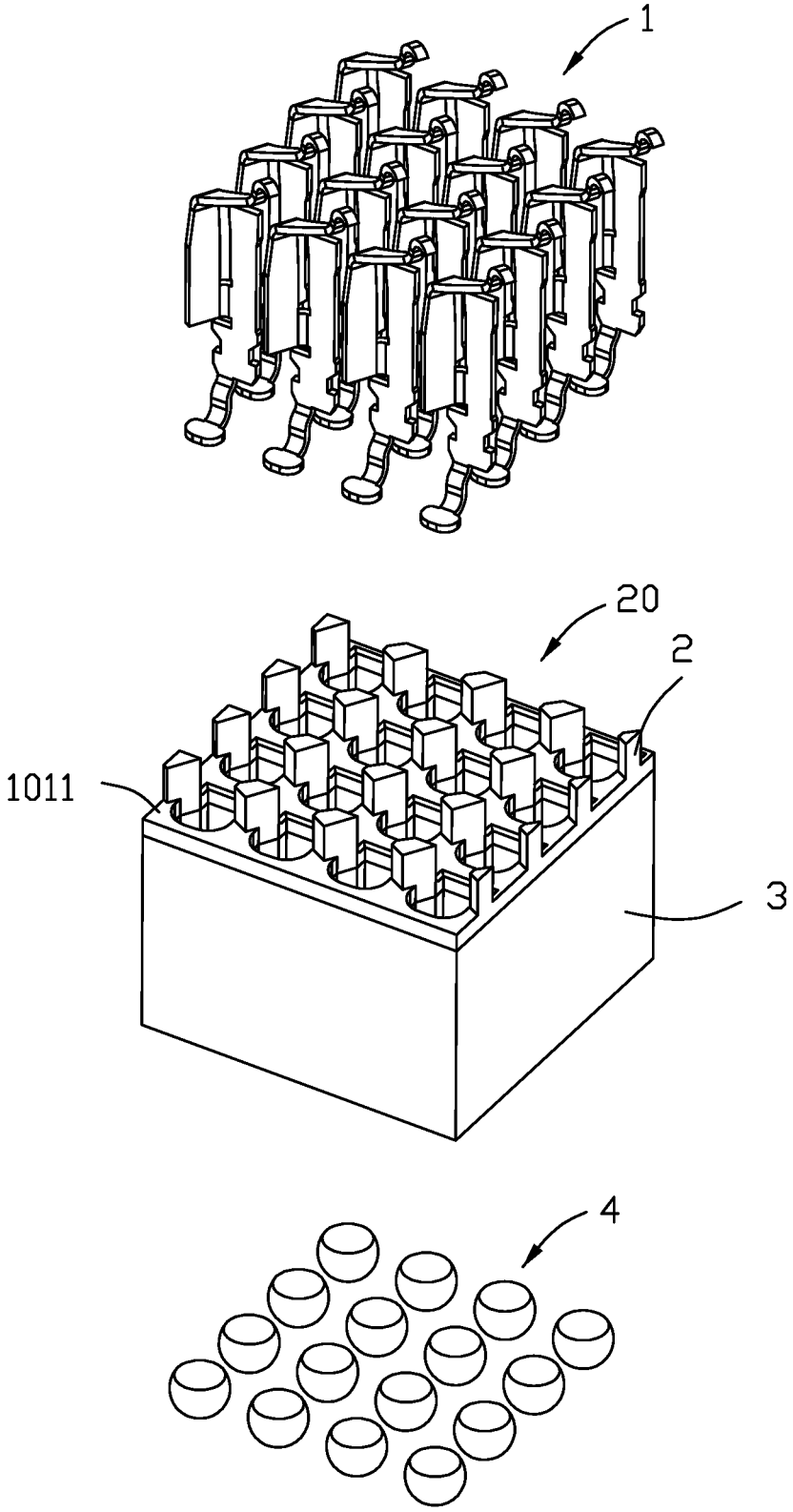
FIG. 3 is an exploded perspective view of the electrical connector of FIG. 1.
Figure 4:
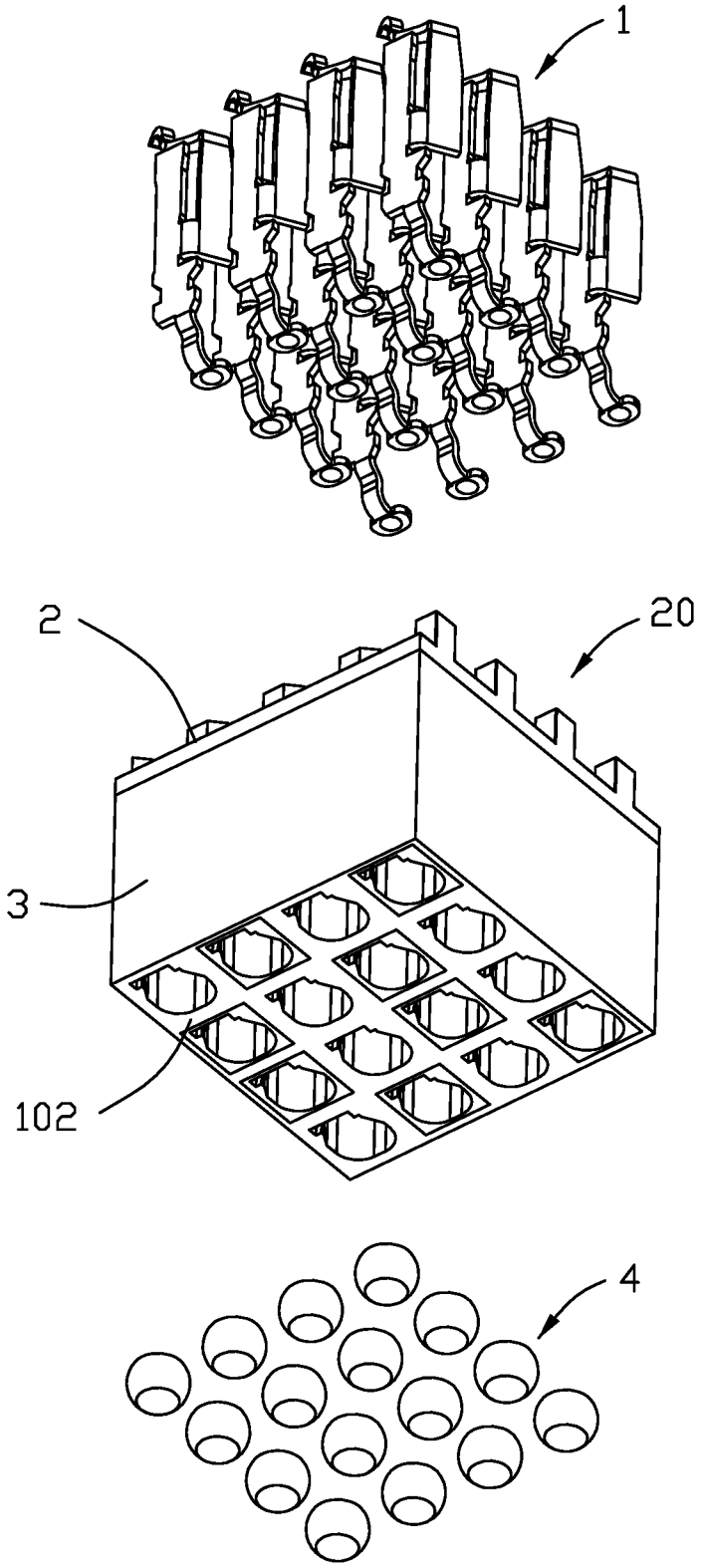
FIG. 4 is another exploded perspective view of the electrical connector of FIG. 3.
Figure 5:
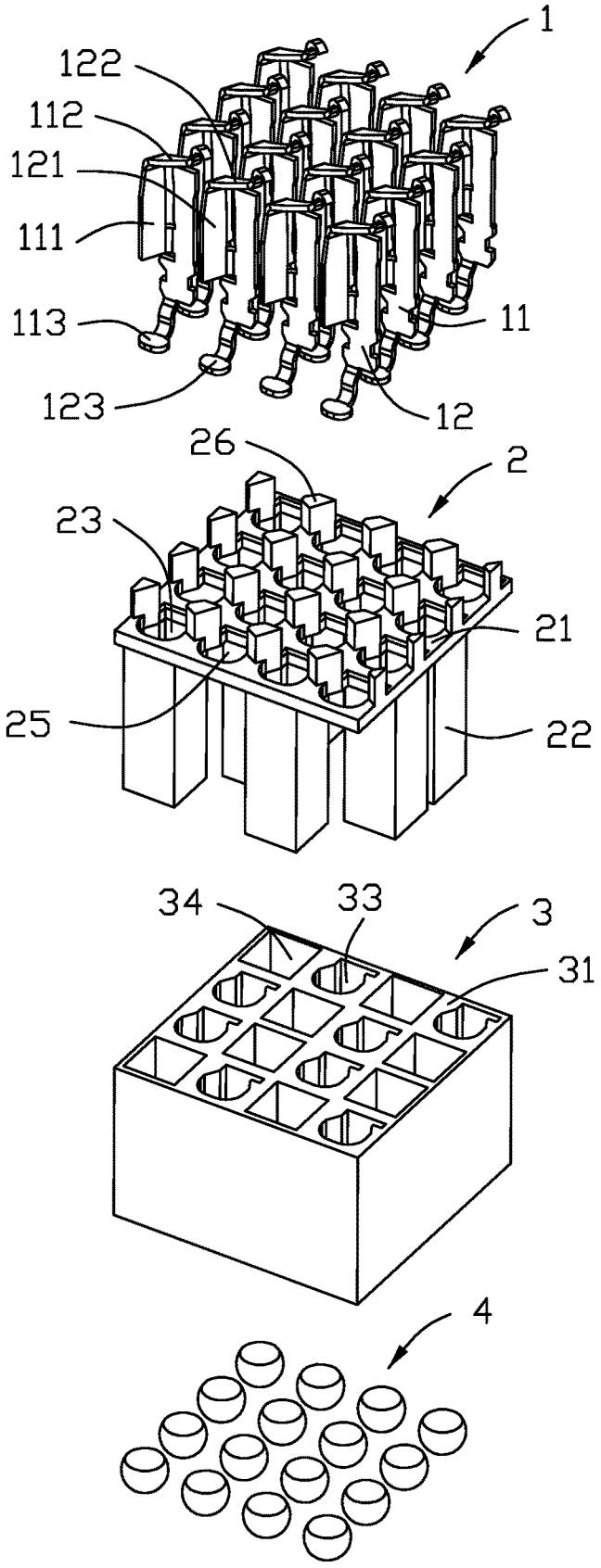
FIG. 5 is a further exploded perspective view of the electrical connector of FIG. 3.
Figure 6:
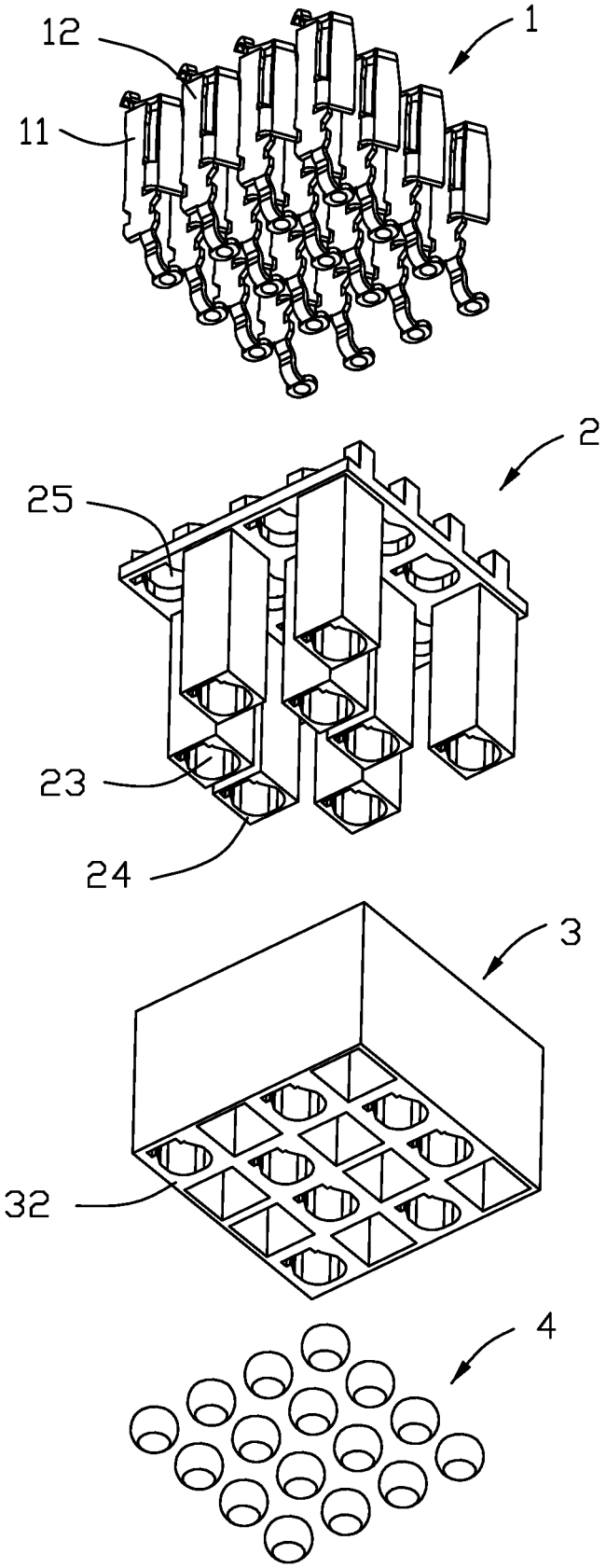
FIG. 6 is another further exploded perspective view of the electrical connector of FIG. 5.

Referring to FIGS. 1-6, an electrical connector 100 for connecting an electronic package (not shown) to a printed circuit board (not shown), includes a housing 20 and a plurality of contacts 1 equipped with the corresponding solder balls 4. The housing 2 includes an insulative plastic body 2 and a conductive plastic body 3.

The contacts 1 include signal contacts 11 and grounding contacts 12 intermixed with each other in matrix. The insulative plastic body 2 formed by injection molding, includes a main plate 21 forming a mating surface 1011 of the housing 20, and a plurality of columns 22 extending downwardly from the main plate 21. Each column 22 forms an insulative retaining passageway 23 extending therethrough in the vertical direction. The conductive plastic body 3 of a block structure is further molded upon the insulative plastic body 2 and forms opposite top surface 31 and bottom surface 32, a plurality of conductive retaining passageways 33 and a plurality of receiving cavities 34 extending through both the top surface 31 and the bottom surface 32 in the vertical direction.

The main plate 21 includes a plurality of through holes 25, of which some are respectively downwardly communicatively aligned with the corresponding insulative retaining passageways 23 for allowing the signal contacts to extend therethrough, and the remaining are respectively downwardly communicatively aligned with the corresponding conductive retaining passageways 33 for allowing the grounding contacts to extend therethrough. A plurality of upstanding posts 26 extend upwardly from the main plate 21 beside the through holes 25, respectively.

The main plate 21 is seated upon the top surface 31 while the bottom surface 24 of the column 22 is coplanar with the bottom surface 32 so as to commonly form a mounting surface 102 of the housing 20. The column 22 is received within the corresponding receiving cavity 34.

Each of the signal contacts 11 and the grounding contacts 12 has a main body 111, 121, the contacting section 112, 122 extending upwardly from the main body 111, 121, the soldering section 113, 123 extending downwardly from the main body 111, 121. The main body 111 of the signal contact 11 is retained within the insulative retaining passageway 23 and isolated from the conductive plastic body 3 by the corresponding column 22 while the main body 121 of the grounding contact 12 is retained within the conductive retaining passageway 33 and directly connected with the conductive plastic body 3. The contacting section 112, 122 extends above the mating surface 1011 of the housing 2 and is restricted by the corresponding upstanding post 26.

During manufacturing, the insulative plastic body 2 is firstly formed by injection molding with the corresponding columns having the corresponding insulative retaining passageways therein, and the conductive plastic body 3 is successively formed by over-molding upon the insulative plastic body 2 with the corresponding conductive retaining passageways and with the corresponding receiving cavities receiving the corresponding columns therein. Furthermore, a plurality of signal contacts are inserted into the corresponding insulative retaining passageways from the top, and a plurality of grounding contacts are inserted into the corresponding conductive retaining passageways from the top. Finally, the solder balls are attached to the soldering sections of both the signal contacts and the grounding contacts. Understandably, because each individual contact unit is surrounded by the conductive plastic body 3, either directly as to the grounding contact 12 or indirectly as to the signal contact 11, the shielding effect for prevention of the cross-talk between the neighboring signal contacts is well performed. Notably, in this embodiment the columns do not occupy all the space units in matrix but only along with the corresponding signal contacts, i.e., eight columns. Anyhow, alternately the column may be arranged with full spaces in matrix, i.e., sixteen columns for a (4×4) matrix, for accommodating both the signal contacts and the grounding contacts. Under such a situation, the conductive plastic body may be of a net configuration in a top view. Understandably, because the conductive plastic body is integrally formed upon the insulative plastic body via an over-molding process, the conductive plastic body can be well sustained disregarding how tiny the gap between every adjacent two columns where the net-like conductive plastic body is formed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a block like housing including retaining therein a plurality of contacts in matrix, said housing including:

an insulative plastic body formed by injection molding and having a horizontal main plate and a plurality of columns extending from the main plate in a vertical direction, each of said columns defining an insulative retaining passageway to receive the corresponding contacts therein, respectively;

a block like conductive plastic body over-molding upon the insulative plastic body to be integrally formed together, and defining opposite top and bottom surfaces in the vertical direction with corresponding receiving cavities extending therethrough in the vertical direction to receive the corresponding columns, respectively.

2. The electrical connector as claimed in claim 1, wherein the main plate forms a plurality of through holes communicatively aligned with the corresponding insulative retaining passageways in the vertical direction, respectively.

3. The electrical connector as claimed in claim 2, wherein said contacts include a plurality of signal contacts and grounding contacts, and only the signal contacts are received within the corresponding insulative retaining passageways, respectively.

4. The electrical connector as claimed in claim 3, wherein said conductive plastic body further forms a plurality of conductive plastic passageways to receive the corresponding grounding contacts, respectively.

5. The electrical connector as claimed in claim 4, wherein the insulative plastic passageways and the conductive plastic passageways are similar to each other while both being different from the receiving cavities in a view taken along the vertical direction.

6. The electrical connector as claimed in claim 4, wherein said main plate further including a plurality of through holes communicatively aligned with the corresponding conductive retaining passageways in the vertical direction, respectively.

7. The electrical connector as claimed in claim 2, wherein the main plate of the insulative plastic body is seated upon the top surface of the conductive plastic body, and the columns extend downward from the main plate.

8. The electrical connector as claimed in claim 7, wherein a plurality of upstanding posts are formed on an upper surface of the main plate around the corresponding through holes, respectively.

9. The electrical connector as claimed in claim 1, wherein an amount of said matrix is N×N while an amount of said columns is less than N×N.

10. A method of making an electrical connector comprising steps of:

providing an insulative plastic body by injection molding with a main plate and a plurality of columns extending from the main plate in a vertical direction, each of said columns defining an insulative retaining passageway therein;

providing a conductive plastic body upon the insulative plastic body via over-molding with a plurality of receiving cavities receiving the corresponding columns, respectively; and downwardly inserting a plurality of contacts into the corresponding insulative retaining passageways, respectively; wherein each of said contacts includes a contacting section exposed upon both the insulative plastic body and the conductive plastic body in the vertical direction.

11. The method as claimed in claim 10, wherein the main plate forms a plurality of through holes communicatively aligned with the corresponding insulative retaining passageways, respectively.

12. The method as claimed in claim 11, wherein said contacts include grounding contacts and signal contacts, and only the signal contacts are received within the corresponding insulative retaining passageways, respectively.

13. The method as claimed in claim 12, wherein said conductive plastic body further forms a plurality of conductive retaining passageways intermixed with the receiving cavities to receive the corresponding grounding contacts therein, respectively.

14. The method as claimed in claim 13, wherein a configuration of each of said insulative retaining passageways is similar to that of each of said conductive retaining passageways while both are different from that of each of the receiving cavities.

15. The method as claimed in claim 13, wherein said main plate further includes a plurality of through holes communicatively aligned with the corresponding conductive retaining passageways, respectively.

16. The method as claimed in claim 15, wherein said main plate of the insulative plastic body is seated upon the conductive plastic body and forms a plurality of upstanding posts thereon around the corresponding through holes, respectively.

17. An electrical connector comprising:

a housing retaining therein a plurality of contacts which are arranged in matrix;

said housing including an insulative plastic body and a conductive plastic body integrally joined together via dual-injection molding; and said contacts including a plurality of signal contacts ad a plurality of grounding contacts intermixed with each other to from said matrix; wherein said insulative plastic body defines a plurality of insulative retaining passageways to receive the corresponding signal contacts therein, said conductive plastic body defines a plurality of conductive retaining passageways to receive the corresponding grounding contacts therein, and said insulative retaining passageways and the said conductive retaining passageways are intermixed with each other to form said matrix.

18. The electrical connector as claimed in claim 17, wherein said conductive plastic body further forms a plurality of receiving cavities to receive the corresponding columns, respectively.

19. The electrical connector as claimed in claim 18, wherein the insulative plastic body forms a plurality of upstanding posts around the corresponding contacts on a top face of the housing.

20. The electrical connector as claimed in claim 18, wherein the insulative plastic body includes a horizontal main plate to unify said columns together.

* * * * *